United States Patent [19]

Perkitny

[11] Patent Number: 4,987,990

[45] Date of Patent: Jan. 29, 1991

[54] COIN BANK

[75] Inventor: Jerzy Perkitny, Cleveland, Ohio

[73] Assignee: Mag-Nif, Inc., Mentor, Ohio

[21] Appl. No.: 384,760

[22] Filed: Jul. 25, 1989

[51] Int. Cl.[5] ..... G07D 3/02

[52] U.S. Cl. ..... 194/242; 446/9; 453/5; D99/35

[58] Field of Search ..... 453/5, 6, 12, 13, 57; 194/240, 245, 242; 446/9, 10, 11, 12; D99/35, 36, 37

[56] References Cited

U.S. PATENT DOCUMENTS

| | | | |
|---|---|---|---|
| D. 296,029 | 5/1988 | Knox | D99/35 |
| 1,947,456 | 2/1934 | Bock | 453/13 |
| 3,258,100 | 6/1966 | Taff | 446/9 X |
| 3,299,899 | 1/1967 | Nadherny | 453/12 |
| 3,997,045 | 12/1976 | Yeung | 446/10 X |
| 4,511,341 | 4/1985 | Spirk et al. | 446/9 |
| 4,607,648 | 8/1986 | Hough | 446/8 X |

OTHER PUBLICATIONS

*Mag-Nif Just For Fun!* brochure, Mag-Nif Inc., Mentor Ohio, 1989.

*Primary Examiner*—F. J. Bartuska

*Attorney, Agent, or Firm*—Renner, Otto, Boisselle & Sklar

[57] ABSTRACT

A visually interesting coin sorter and bank receives a group of random coins in a coin receiving chamber and ejects the coins one-at-a-time to roll to the bottom of a rotatable transparent spiral elevator plate or wheel. The spiral wheel lifts the rolling coins toward the center of the wheel until caught by size restrictions in the spiral to be then moved through an arc and to drop through a proper slot to form sorted stacks of coins. The spiral wheel is driven through an electric motor which is automatically turned on as soon as one or more coins are dropped in the chamber. Aftet the last coin is sorted the motor is automatically turned off. A coin sensing lever in the coin receiving chamber releases a cycle timer to close a switch to start the motor. The rotating spiral wheel drives an ejector slide to eject the coins one-at-a-time from the chamber. When the last coin is ejected the lever sensing the absence of a coin engages the cycle timer which is driven by the wheel to turn the motor off after such last coin is sorted.

39 Claims, 8 Drawing Sheets

COIN BANK

BACKGROUND OF THE INVENTION

Motorized coin banks are employed both as novelties or toys and as coin sorting banks. One such bank sold by Mag-Nif Inc. of Mentor, OH, U.S.A., sold under the trademark MONEY FACTORY, utilizes a reciprocating conveyor to march random coins in a single file from a hopper across the conveyor, and with each pulse of the conveyor the coins flip over. After marching across the conveyor the coins are sorted and stacked into a column. While visually interesting, the bank does not use the rolling of the coin on edge to obtain such interest.

Other banks do use the rolling of the coin on edge to obtain such interest. However, such banks use gravity ramps, wheels, levers and cranks as the coins roll downhill to the top of the coin compartment columns. An example of such bank is that sold by Mag-Nif Inc. under the trademark MONEY MACHINE ACTION BANK.

It has been found that an interesting visual effect can be obtained by letting the coin roll to the bottom, and then elevate the coin while rolling to be caught and moved through an arc to drop into the appropriate coin compartment.

SUMMARY OF THE INVENTION

A visually interesting coin sorter and bank receives a group of random coins in a coin receiving chamber and ejects the coins one-at-a-time to roll to the bottom of a rotatable transparent spiral elevator plate or wheel. The spiral wheel lifts the rolling coins toward the center of the wheel until caught by size restrictions in the spiral to be then moved through an arc and to drop through a proper slot to form sorted stacks of coins. The spiral wheel is driven through an electric motor which is automatically turned on as soon as one or more coins are dropped in the chamber. After the last coin is sorted the motor is automatically turned off. A coin sensing lever in the coin receiving chamber releases a cycle timer to close a switch to start the motor. The rotating spiral wheel drives an ejector slide to eject the coins one-at-a-time from the chamber. When the last coin is ejected the lever sensing the absence of a coin engages the cycle timer which is driven by the wheel to turn the motor off after such last coin is sorted.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
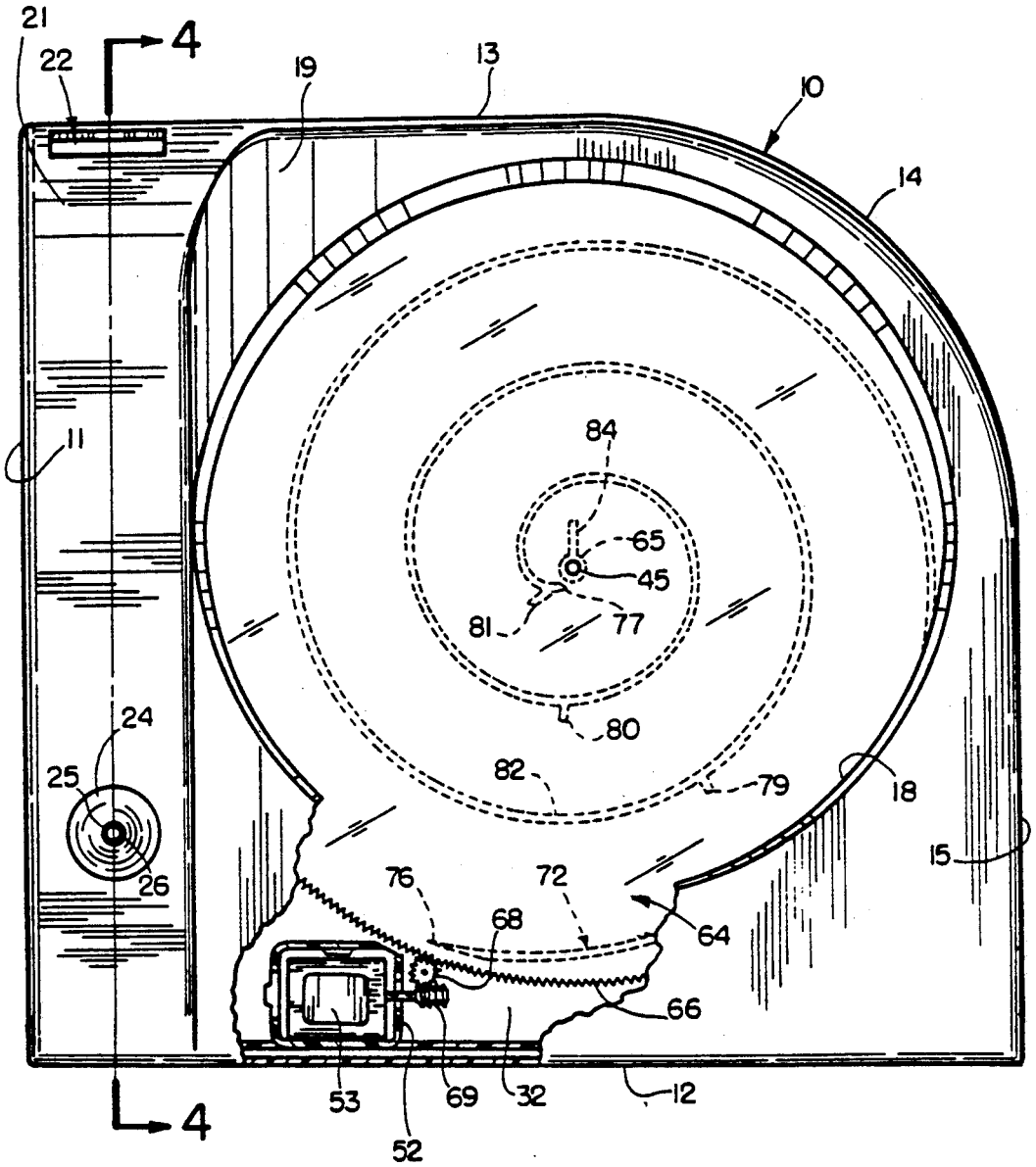
FIG. 1 is a front elevation partially broken away of a coin bank in accordance with the present invention.

Referring initially to FIG. 1 there is illustrated a coin bank in accordance with the present invention which comprises a housing shown generally at 10. The housing includes a bottom wall 11, a side wall 12, and a top wall which extends through substantial radius 14 to contiguous other side wall 15.

The right hand side of the front of the housing includes a front wall which extends slightly inclined rearwardly and which is provided with a circular opening 18. The slightly rearwardly inclined front wall portion of the housing is dished or scalloped away from the left hand portion of the housing as indicated at 19.

Figure 4:
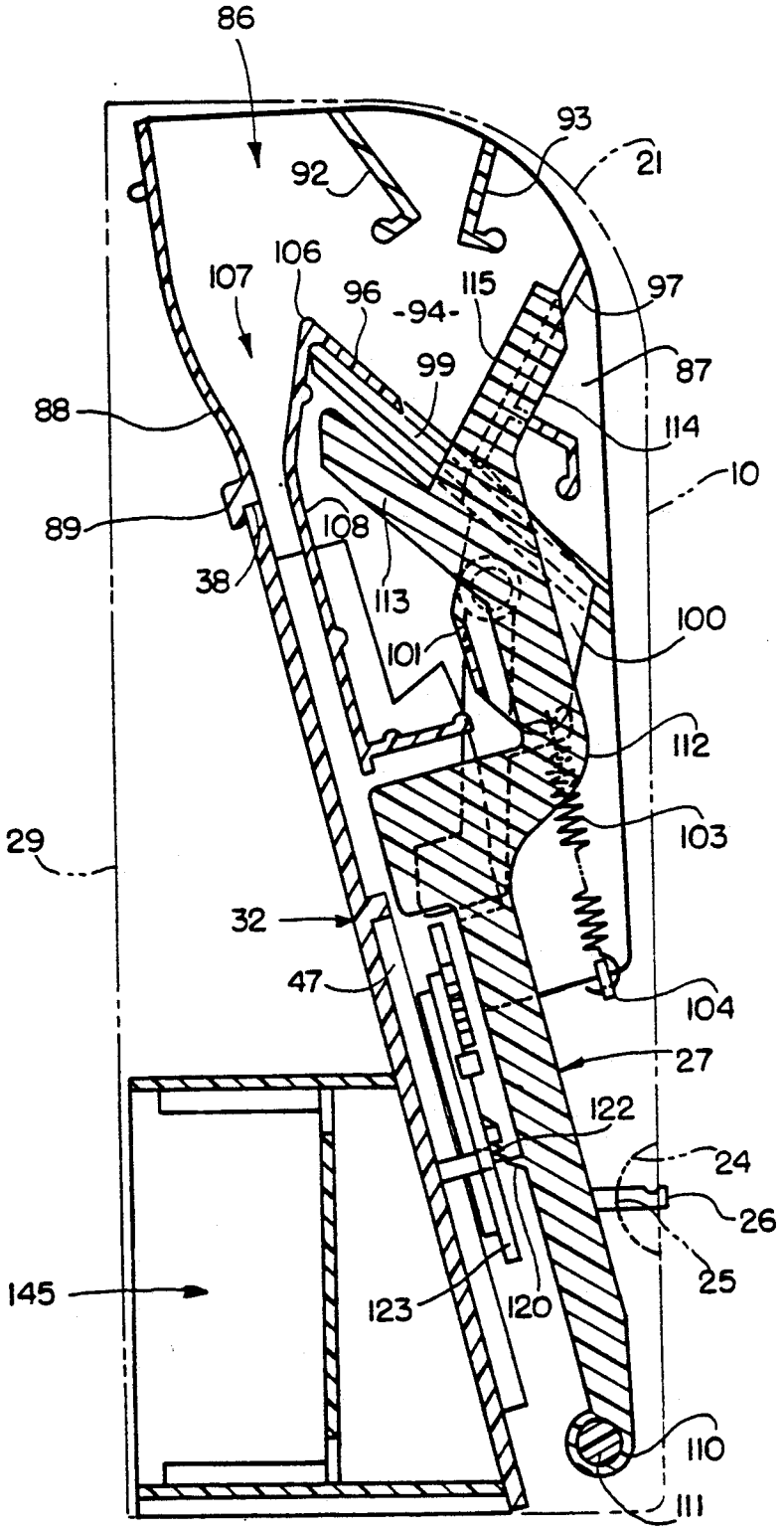
FIG. 4 is a vertical section through the coin loading chute as seen from the line 4—4 in FIG. 1.

To the left of the circular opening and the scallop 19 the housing 10 has the external configuration seen more clearly by the phantom line outline in FIG. 4 with the top front being rounded as seen at 21 and provided with a coin receiving opening 22. The front of the left hand portion of the housing near the bottom is provided with a semi-spherical dimple seen at 24 which is provided with a center hole 25 through which a stem 26 projects, such stem being part of cycle start lever 27 to enable the cycle start lever to be moved manually. The back of the housing indicated at 29 in FIG. 4 is provided with a removable back plate, not shown.

Figure 2:
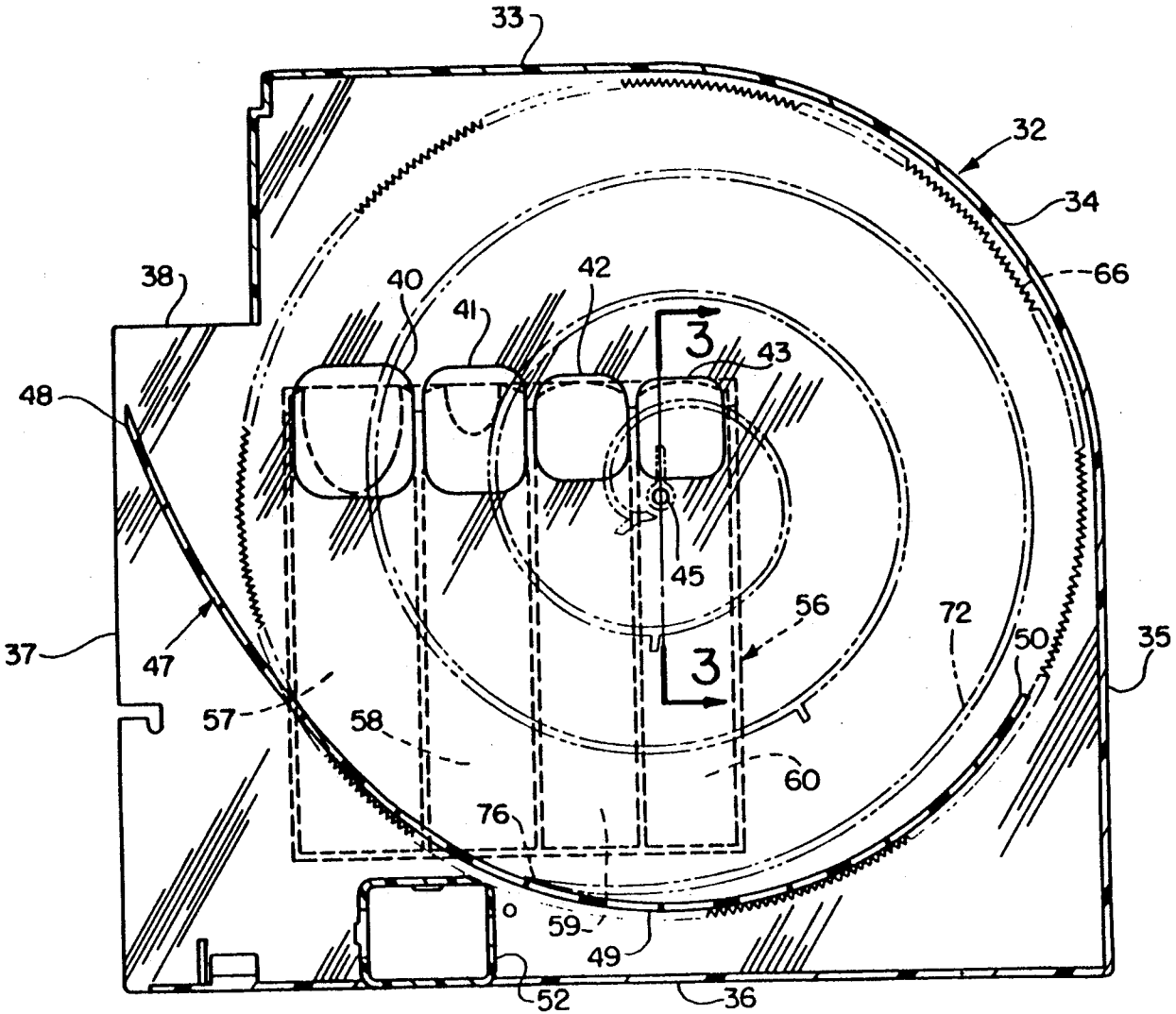
FIG. 2 is a front elevation of the coin sorter plate illustrating the superimposed spiral coin loader plate or wheel and the coin sorter stack chamber to the rear.
Figure 3:
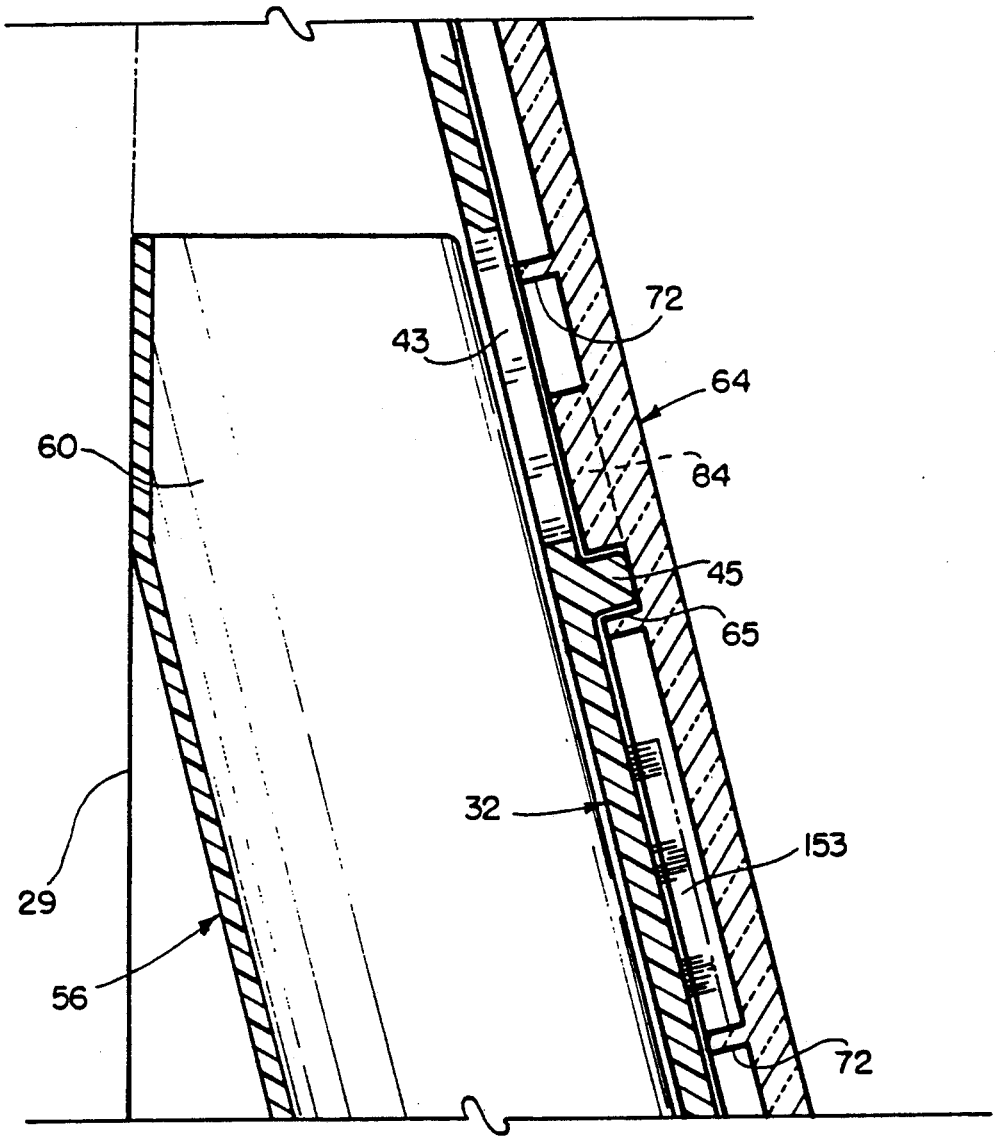
FIG. 3 is an enlarged vertical section through the spiral coin loader plate journal as seen from the line 3—3 of FIG. 2.

Referring now additionally to FIGS. 2, 3 and 4 it will be seen that the interior of the housing is provided with a slightly rearwardly inclined coin sorter plate 32. The coin sorter plate 32 has a profile corresponding generally to the interior of the housing and includes a horizontal top 33 extending through a rather large radius 34 to side 35. The bottom 36 extends the full width of the housing while the left hand edge 37 extends less than the full height terminating in edge 38 spaced from the top 33 of the plate.

The coin sorter plate includes four generally rectangular holes indicated at 40, 41, 42 and 43, each of which somewhat varies in size and which are designed to receive different size coins such as a U.S. quarter, nickel, penny and dime, respectively. Such holes are arranged in a generally horizontal orientation.

Immediately below and to the left of the center of the hole 43 the plate 32 is provided with a short projecting pintle 45 which projects toward the viewer in FIG. 2. The pintle is in the center of the circular opening 18 of the housing.

The plate 32 also includes a curved ridge or ramp 47 which also projects toward the viewer in FIG. 2. The ramp 47 starts adjacent the left hand edge 37 of the plate somewhat below the edge 38 as indicated at 48 and continues downwardly in a curved fashion to a lowermost point 49 directly below the pintle 45. From the lowermost point the ramp curves upwardly on a radius from the pintle 45 to the point 50. The ramp for the most part is coincident with or just below the lower edge of the hole 18 in the housing. The purpose of the ramp is to receive coins from the ejector to roll on edge to the bottom of the ramp as hereinafter described. The front of the plate 32 also includes a housing 52 for motor 53 seen in FIG. 1.

Immediately behind the coin sorter plate 32 there is provided a coin sorter 56 which, together with the coin sorter plate 32, forms four vertically extending chambers seen at 57, 58, 59 and 60, such chambers being sized to receive the particular coin passing through the holes 40, 41, 42 and 43, respectively. Such chambers extend downwardly from the holes which are in communication with the top of the chambers. The coin sorter 56 is a plastic part which may be attached to the back plate and removed therewith to provide access to coins stacked in the chambers.

Mounted on the pintle 45 for rotation is a transparent spiral coin loader plate or wheel 64. As seen in FIG. 3 the pintle 45 is received in a circular socket 65. As indicated, the plate 64 is transparent plastic and formed around the periphery thereof are the teeth 66 forming a bull gear. The bull gear is in mesh with pinion 68 mounted for rotation on the plate 32 and driven by worm 69 on the output shaft of motor 53. In this manner the motor drives the circular plate 64 for rotation about the pintle 45.

On the interior of the plate 64 there is provided a spiral ridge shown generally at 72. The spiral ridge projects away from the viewer in FIG. 1 or toward the face of the plate 32 and forms with the face of the plate 32 a rolling coin elevating slot between the plates 32 and 64. The spiral ridge commences at the periphery of the plate 64 in a pointed or knife edge end 76 and continues spiralling continuously and uniformly to the center of the plate terminating at 77 adjacent the hub 65. It is noted that the spiral is rather tight making three complete revolutions from the radial extremities or point 76 to the point 77, while the radial distance between adjacent convolutions changes only slightly.

Projecting from the ridge at spirally spaced locations are sizing restrictions seen at 79, 80 and 81. Such sizing restrictions each projects from the same side of the ridge and toward the opposite side of the spiral ridge which is continuous and on which the coins roll. The size restriction is formed by the dimension from the tip of the restriction to the opposed continuous side of the spiral ridge. For example, the dimension between the tip of the restriction 80 and the point 82 on the ridge opposite the restriction forms the dimension designed to catch a certain size coin rolling on the ridge. The restriction for quarters may be the restriction 79, for nickels the restriction 80, and for pennies the restriction 81. For dimes a finger 84 projecting from the hub 65 moves the dimes into the hole 43. As seen in FIG. 2 the leading knife edge 76 of the spiral ridge sweeps adjacent the upper edge of the curved ramp 47 when the plate 64 rotates.

Figure 5:
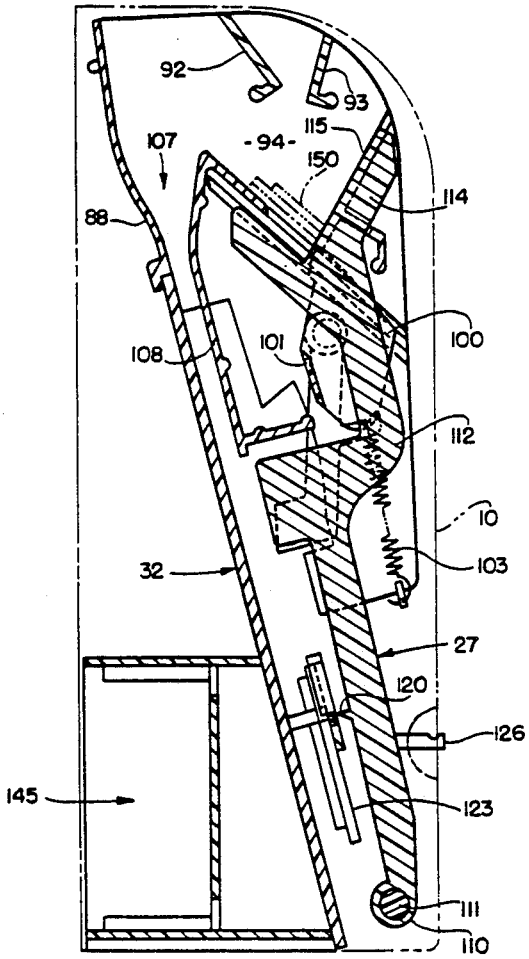
FIG. 5 is a view similar to FIG. 4 but illustrating several coins dropped into the chute and the cycle start lever having disengaged the cycle timer.
Figure 6:
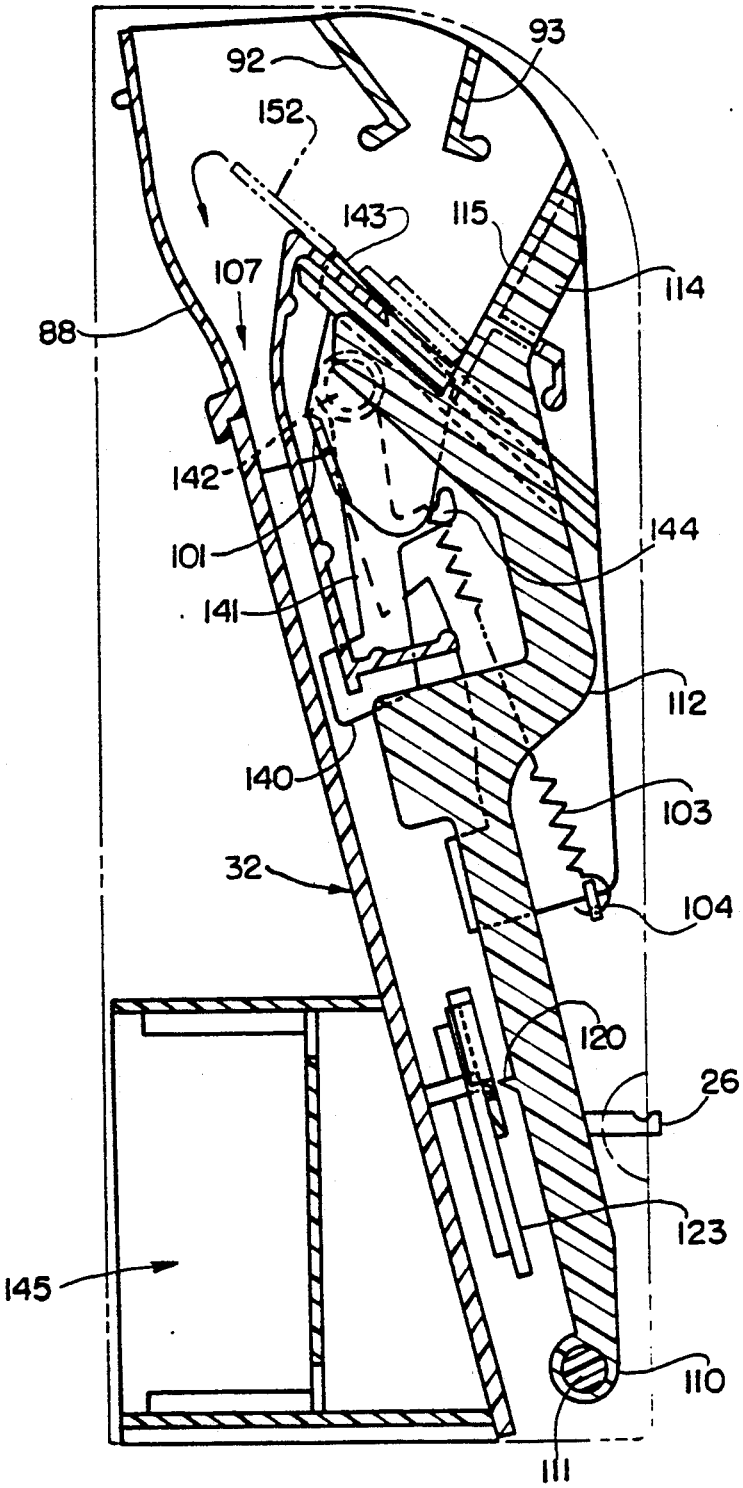
FIG. 6 is a view similar to FIGS. 4 and 5 illustrating the action of the eject slide and lever to eject coins one-at-a-time to roll to the bottom of the spiral coin loader plate.

Referring now to FIGS. 4, 5 and 6 it will be seen that the left hand part of the housing seen in FIG. 1 incorporates a coin chute shown generally at 86 which is formed of mating right and left hand plastic parts which, when joined, form the coin chute illustrated. The coin chute includes one side wall 87, the one toward the viewer in FIG. 4 not being illustrated, but which extends to the bottom of the housing. The coin chute is approximately the width of the shoulder edge 38 on the plate 32 and includes a back wall seating on such edge at the enlarged shoulder forming portion indicated at 89. The coin chute also includes two opposed inclined walls 92 and 93 which funnel coins from the housing coin slot 22 into coin receiving chamber 94.

The bottom of the chamber 94 is formed by V-shape inclined walls 96 and 97. Both walls are slotted to accommodate slight movement of the upper end of the cycle start lever 27 and the wall 96 is provided with gibs 99 to accommodate sliding movement of coin eject slide 100. In order to clear the cycle start lever 27 the eject slide 100 is of a generally U-shape configuration with the legs of the U being joined as indicated at 101. In this manner the eject slide 100 will move back and forth along the gibs 99 without interfering with the cycle start lever. A tension spring 103 which is anchored as seen at 104 urges the eject slide to its retracted position seen in FIG. 4. The inclined wall 96 is at an angle of inclination not as steep as the wall 97 and extends upwardly to a lip 106 at the top of chute 107 which is formed by the back wall 88 and the plate 32 on the one hand and the wall 108 on the other. As hereinafter explained, as the eject slide 100 is driven upwardly along the gibs 99 it will eject a coin one at a time from the chamber 94 to drop into the chute 107. Upon dropping into the chute 107 the coin will be picked up by the curved ramp 47 to roll to the bottom of the rotating spiral coin loader plate 64.

The cycle start lever 27 is a relatively thin lever and includes a hub 110 at the bottom pivoted on pintle 111 which may project from the inner wall, not shown, of the coin chute. The lever extends upwardly and includes an offset 112 and terminates at the top in an L-shape portion including short leg 113 and a somewhat longer leg 114, the forward edge 115 of which projects slightly into the coin receiving chamber 94 in the position of such start lever seen in FIG. 4. This position may be termed the no coin position. The start lever is thus free to pivot a short distance as can be seen by comparing the position of the start lever in FIGS. 4 and 5. In FIG. 5 the start lever has pivoted to the right as seen in such Figure, such pivoting being caused by the weight of coins indicated generally at 150 in the coin receiving chamber 94. When the coins are absent from the coin receiving chamber 94 the center of gravity of the start lever 27 will cause it to swing back to or return to the position seen in FIG. 4.

Figure 7:
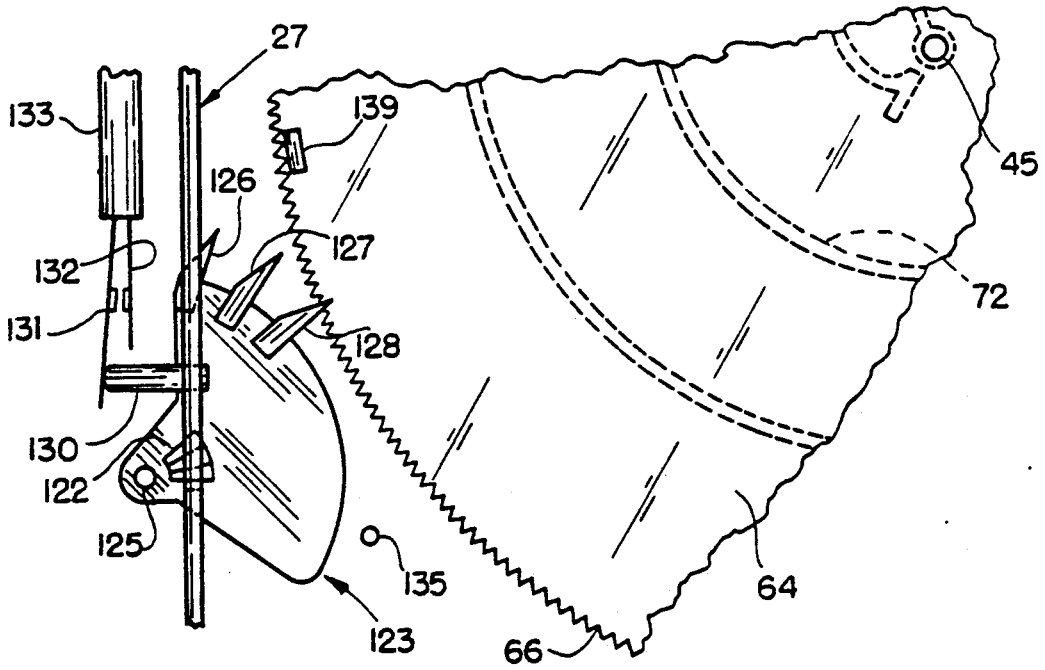
FIG. 7 is a fragmentary view as seen from the right hand side of FIG. 4 illustrating the cycle start lever and cycle timer engaged, the latter holding open the contacts of the motor switch.
Figure 8:
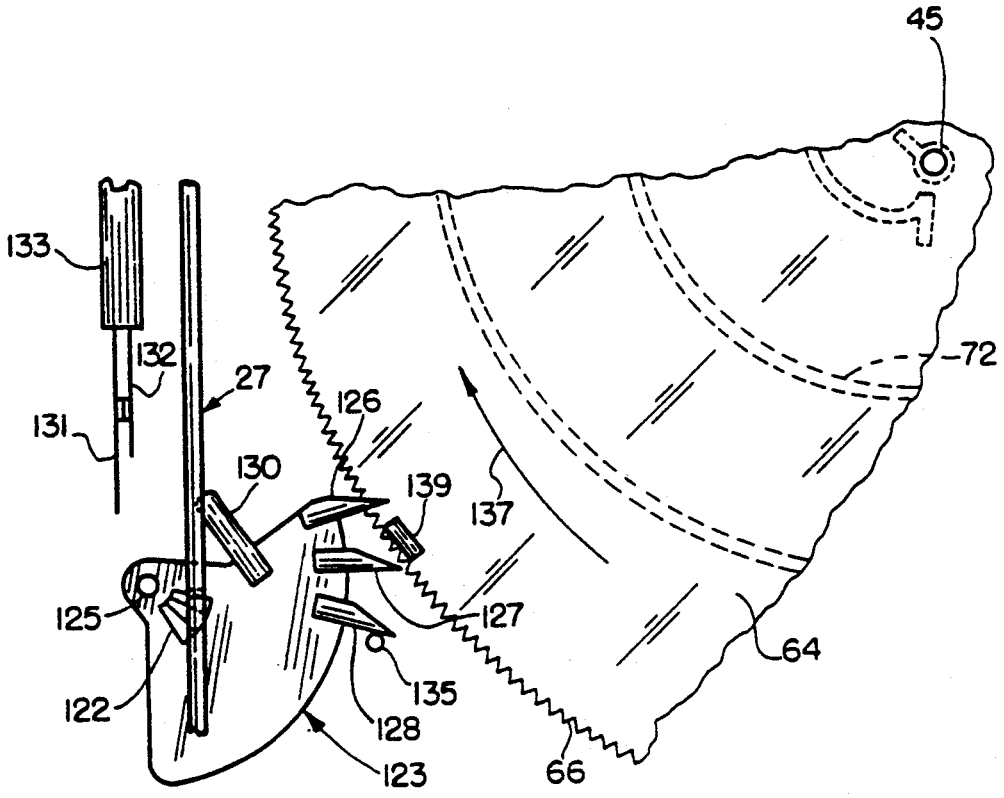
FIG. 8 is a view similar to FIG. 7 illustrating the release of the cycle timer closing the contacts and rotating the spiral coin loader plate.
Figure 9:
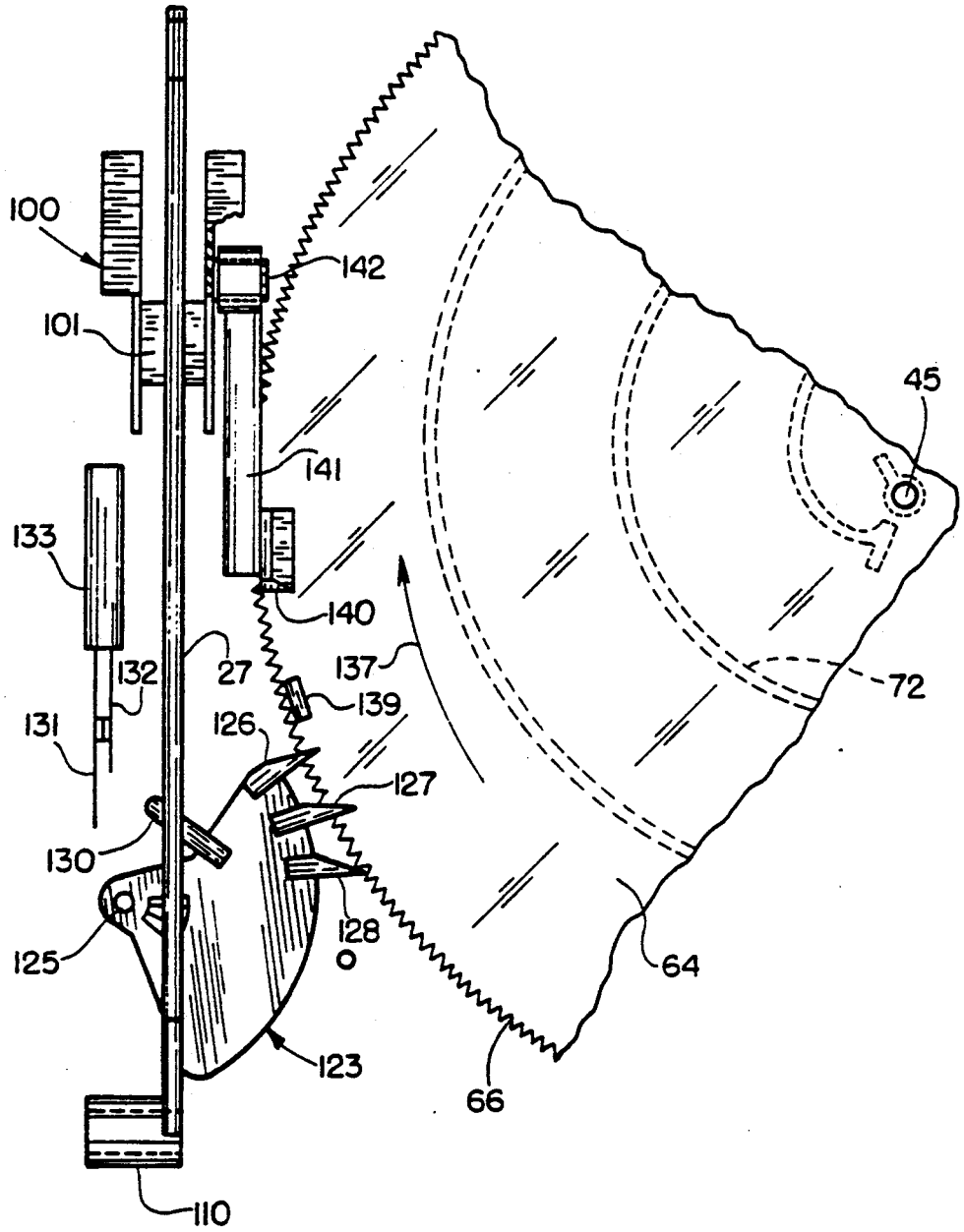
FIG. 9 is a view similar to FIG. 8 illustrating the cycle timer in an intermediate position and the position of the eject lever and slide vis-a-vis the spiral coin loader plate.

The stem of the start lever is provided with a ratchet tooth indicated at 120 which in the position of the start lever of FIG. 4 meshes with ratchet teeth 122 of cycle timer 123. The cycle timer is shown in detail in FIGS. 7, 8 and 9 and is pivoted to swing in a plane normal to the plane of FIG. 4. The ratchet teeth 122 are three in number and extend radially from the pivot 125. The cycle timer also includes a circular face from which teeth 126, 127 and 128 project. The angular spacing of the teeth 126, 127 and 128 is the same as the three ratchet teeth 122. Also projecting from the cycle timer 123 is a pin projection 130 which is designed to engage the somewhat longer leaf contact 131 and push it away from leaf contact 132 of switch 133 as seen in FIG. 7. Switch 133 operates the motor 53. When the cycle timer is in the position shown in FIG. 7 the motor is shut off. When the cycle timer is released it drops to the position seen in FIG. 8 with the tooth 128 engaging pin 135. In such position the contacts are closed and the motor 53 rotates the spiral coin loader plate 64 in the direction of the arrow 137.

It is noted that the spiral coin loader plate is provided with a slight projection or dog 139 which interferes with the teeth 126, 127 and 128. If the cycle timer is released from the cycle start lever 27 the engagement of the dog 139 with the tooth 126 will simply momentarily lift the cycle timer about the pivot 125 and then drop it back until the tooth 128 engages the pin 135. If there is engagement between the cycle start lever and the cycle timer, the engagement of the dog with the respective teeth with move the cycle timer incrementally from the position of FIG. 8 through the position of FIG. 9 and back to the position of FIG. 7 wherein the switch contacts are opened and the motor is stopped.

The dog 139 also engages the lower end 140 of eject lever 141 which is pivoted at its upper end at 142 to the eject slide 100. Thus every time the plate 64 makes a complete revolution, it will momentarily drive the eject slide upwardly along the gibs 99 elongated the spring 103 with the slight projecting edge 143 thereof seen in FIG. 6 ejecting the coins one at a time from the coin receiving chamber 94 to fall through the chute 107. As seen more clearly in FIG. 6, it is noted that the upper end of the spring 103 is anchored to arm 144 projecting from the eject lever. In this manner the spring not only retracts the slide 100 but also urges the lower end 140 of eject lever 141 against the face of plate 64. When the dog clears the bottom of the eject lever, the spring returns the eject lever to the position seen in FIGS. 4 or 5.

As seen in FIG. 4, the back of the plate 32 is provided with a battery compartment shown generally at 145 which may contain a single C size 1.5 volt battery. The switch 133 simply opens and closes the circuit from the battery to the motor.

OPERATION

Referring initially to FIGS. 4 and 7 it will be seen that the cycle timer 123 is in its elevated position opening the contacts 131 and 132 and is held in such position by the engagement of the tooth 120 of the cycle start lever with the ratchet teeth 122 on the cycle timer. This engagement is obtained because the cycle start lever 27 has fallen toward the left as seen in FIG. 4 with the edge 115 projecting slightly into the coin receiving chamber 94.

Referring now to FIG. 5 it will be seen that a number of random coins indicated at 150 have been dropped into the coin receiving chamber 94 and slide to the bottom of the chamber engaging the edge 115 and pivoting the cycle start lever 27 about the pivot 111 to the right as seen in FIG. 5 disengaging the tooth 120 from the ratchet teeth 122 of the cycle timer 123. Upon such disengagement the cycle timer then drops to the position seen in FIG. 8 with the tooth 128 abutting the pin 135. This closes the contacts 131 and 132 and the motor now rotates the plate 64 in the direction of the arrow 137. As long as one or more coins are in the coin receiving chamber 94 the cycle start lever will remain in its position seen in FIG. 5 and the cycle timer will remain in the position seen in FIG. 8.

As the plate 64 rotates the projection 139 engages the lower edge 140 of the eject lever 141 driving the eject slide upwardly along the gibs 99 ejecting one coin at a time indicated at 152 in FIG. 6 to drop into the chute 107. On dropping into the chute 107 the coin now engages the ramp 47 seen in FIG. 2 and rolls to the center bottom of the space between the plate 32 and the plate 64. As the knife edge tip 76 of the spiral ridge 72 in effect scrapes over the ramp, the coin will start to roll on the spiral ridge and be elevated toward the center 45 of the transparent plate. A rolling elevated coin is seen at 153 in FIG. 3. Such elevation will continue until the coin is caught by one of the projecting size restriction fingers whereupon the coin will be moved through an arc to drop into the appropriate opening 40, 41, 42, or 43 to fall into the coin sorting chambers 57, 58, 59 or 60.

Every time the plate 64 rotates a complete revolution, the projection 139 will engage the lower end 140 of the eject lever 141 moving the eject slide 100 to eject another coin from the group into the chute 107. This will continue until there are no further coins in the coin receiving chamber 94. While the coins are being ejected from the chamber one at a time the cycle timer simply flops back to the position seen in FIG. 8 because the tooth 120 and the ratchet teeth 122 are not engaged.

As soon as the last coin is ejected from the chamber 94, the cycle start lever will then swing back to the position seen in FIG. 4 and the tooth 120 will engage the ratchet teeth 122. Now upon the completion of one further revolution the cycle timer will begin to climb back to its original position seen in FIG. 7, FIG. 9 being one intermediate position. When the projection 139 engages the final projecting tooth 128 it moves the cycle timer back to the position seen in FIG. 7 opening the contacts 131 and 132 stopping the motor and stopping the rotation of the plate 64. The parts will remain in the position seen in FIGS. 4 and 7 until further coins are dropped into the coin receiving chamber 94. Because the plate 64 is transparent the rolling of the coins up the spiral ridge 72 is readily visible until caught by a size restriction and rotated through an arc to drop into the selected hole.

It will be appreciated that the ridge 72 does not need to be a continuous curved spiral as illustrated but can have irregular corners as long as the coin rolls along the ridge surfaces to provide the visual effect of the coin rolling upwardly to be caught to be moved into the proper hole.

It will also be appreciated that the cycle of the operation of the bank may be started without the dropping of coins into the coin receiving chamber by simply tilting the bank to the right as seen in FIG. 4 to cause the lever to move, or by manually pulling the stem 26, such movement of the cycle start lever then releasing the cycle timer to commence the cycle. It is of course necessary that the cycle start lever return to its position seen in FIG. 4 for the cycle to be completed.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A coin bank comprising an upright first plate, an opposed second plate parallel to said first plate and journalled for rotation with respect to said first plate, a ridge projecting from said second plate toward said first plate, a radially extending sizing restriction projecting from said ridge, an elevated coin hole in said first plate, means to drop a coin into said bank to roll to the bottom of said opposed plates, and means to rotate said second plate with respect to said first plate to elevate the coin while rolling on said ridge until caught by the sizing restriction to be then elevated through an arc to drop through said hole.

2. A coin bank as set forth in claim 1 including collection chamber for the coins dropping through said hole.

3. A coin bank as set forth in claim 2 wherein said second plate is circular.

4. A coin bank as set forth in claim 3 wherein said first and second plates are inclined slightly away from the front of the bank.

5. A coin bank as set forth in claim 4 wherein said second plate is toward the front of said bank and is transparent.

6. A coin bank as set forth in claim 5 including a housing and an inclined circular hole in said housing exposing said first and second plate.

7. A coin bank as set forth in claim 1 including a plurality of coin sorting holes in said first plate, and respective sizing restrictions on said second plate to catch a rolling coin and elevate it through an arc to drop into the appropriate coin sorting hole.

8. A coin bank as set forth in claim 7 including respective collection chambers for each sorting hole.

9. A coin bank as set forth in claim 8 including a coin receiving chamber, and ejection means to eject coins from said coin receiving chamber one at a time to drop to the bottom of said opposed plates.

10. A coin bank as set forth in claim 9 including means responsive to rotation of said second plate to operate said ejection means.

11. A coin bank as set forth in claim 10 including power means to rotate said second plate, and means responsive to the presence of one or more coins in said coin receiving chamber to energize said power means.

12. A coin bank as set forth in claim 11 including means responsive to a predetermined number of revolutions of said second plate following the ejection of the last coin from said coin receiving chamber to de-energize said power means.

13. A coin bank as set forth in claim 12 wherein said last mentioned means comprises a two position cycle start lever projecting into said coin receiving chamber, and a cycle timer engaging said lever when in a no coin position, said timer being driven by the rotation of said second plate.

14. A coin bank as set forth in claim 13 wherein said second plate is circular, and a bull gear surrounding said second plate.

15. A coin bank as set forth in claim 14 wherein said power means is a motor driving said bull gear.

16. A coin bank as set forth in claim 15 including a switch operating said motor, said switch being operated by said cycle timer.

17. A coin bank as set forth in claim 16 wherein said cycle timer is released by a coin engaging said lever to close said switch.

18. A coin bank as set forth in claim 17 including a single tooth on said cycle start lever, and ratchet teeth on said cycle timer, said tooth engaging said ratchet teeth when said lever is in a no coin position.

19. A coin bank as set forth in claim 18 wherein said cycle timer is pivoted and when released closes said switch and drops to a position to be engaged by a projection on said second plate.

20. A coin bank as set forth in claim 19 including three circumferentially spaced projections on said cycle timer operative to engage the projection on said second plate, whereby when said start lever returns to a no coin position, said tooth engages said ratchet teeth, and three successive revolutions of said second plate will return said cycle timer to its position opening said switch.

21. A coin bank as set forth in claim 1 wherein said ridge is in the form of a spiral.

22. A coin bank comprising an upright first plate, an opposed second plate parallel to said first plate and journalled for rotation with respect to said first plate, a spiral ridge projecting from said second plate toward said first plate, a plurality of elevated coin classifying holes in said first plate, means to drop a coin into said bank to roll to the bottom of said opposed plates, and means to rotate said second plate with respect to said first plate to elevate the coin rolling on said spiral ridge to drop through the appropriate coin classifying hole.

23. A coin bank as set forth in claim 22 including collection chambers for the coins dropping through said coin classifying holes.

24. A coin bank as set forth in claim 23 wherein said second plate is circular.

25. A coin bank as set forth in claim 24 wherein said first and second plates are inclined slightly away from the front of said bank.

26. A coin bank as set forth in claim 25 including a housing, a circular hole exposing said second plate, said second plate being transparent to expose said first plate and the coins moving as aforesaid.

27. A coin bank as set forth in claim 25 including a coin receiving chamber, and ejection means to eject coins from said coin receiving chamber one at a time to drop to the bottom of said opposed plates.

28. A coin bank as set forth in claim 27 including means responsive to rotation of said second plate to operate said ejection means.

29. A coin bank as set forth in claim 28 including power means to rotate said second plate, and means responsive to the presence of one or more coins in said coin receiving chamber to energize said power means.

30. A coin bank as set forth in claim 29 including means responsive to a predetermined number of revolutions of said second plate following the ejection of the last coin from said coin receiving chamber to de-energize said power means.

31. A coin bank as set forth in claim 30 wherein said last mentioned means comprises a two position cycle start lever projecting into said chamber, and a cycle timer engaging said lever when in a no coin position, said timer being driven by the rotation of said second plate.

32. A coin bank as set forth in claim 31 wherein said second plate is circular, and a bull gear surrounding said second plate.

33. A coin bank as set forth in claim 32 wherein said power means is a motor driving said bull gear.

34. A coin bank as set forth in claim 33 including a switch operating said motor, said switch being operated by said cycle timer.

35. A coin bank as set forth in claim 34 wherein said cycle timer is released by a coin engaging said arm to close said switch.

36. A coin bank as set forth in claim 35 including a single tooth on said cycle start lever, and ratchet teeth on said cycle timer, said tooth engaging said ratchet teeth when said lever is in a no coin position.

37. A coin bank as set forth in claim 36 wherein said cycle timer is pivoted and when released closes said switch and drops to a position to be engaged by a projection on said second plate.

38. A coin bank as set forth in claim 37 including three circumferentially spaced projections on said cycle timer operative to engage the projection on said second plate, whereby when said start lever returns to a no coin position, said tooth engages said ratchet teeth, and three successive revolutions of said second plate will return said cycle timer to its position opening said switch.

39. A coin bank as set forth in claim 22 including radially extending coin sizing restrictions on said second plate operative to catch a rolling coin being elevated and swing it through an arc to drop through the appropriate coin classifying hole.

* * * * *